United States Patent [19]

Nakatsugawa

[11] Patent Number: 4,683,460

[45] Date of Patent: Jul. 28, 1987

[54] INTRUSION ALARM SYSTEM WITH AUTOMATIC EXIT CONTROL AND MISSET INDICATOR

[75] Inventor: Norihiko Nakatsugawa, Fuji, Japan

[73] Assignee: Kabushiki Kaisha Toshiba, Kawasaki, Japan

[21] Appl. No.: 736,949

[22] Filed: May 22, 1985

[30] Foreign Application Priority Data

May 25, 1984 [JP] Japan ..... 59-105961

[51] Int. Cl.[4] ..... G08B 13/08

[52] U.S. Cl. ..... 340/545; 340/501; 340/528

[58] Field of Search ..... 340/545, 501, 528

[56] References Cited

U.S. PATENT DOCUMENTS

| | | | |
|---|---|---|---|
| 3,449,738 | 6/1969 | Chesnul et al. | 340/545 |
| 3,803,576 | 4/1974 | Dobrzanski et al. | 340/545 |
| 4,150,369 | 4/1979 | Gaspari et al. | 340/545 |
| 4,543,568 | 9/1985 | Hwang | 340/528 |

FOREIGN PATENT DOCUMENTS

| | | |
|---|---|---|
| 58-68192 | 4/1983 | Japan . |
| 58-214999 | 12/1983 | Japan . |
| 1404341 | 8/1975 | United Kingdom . |
| 1529947 | 10/1978 | United Kingdom . |
| 1548638 | 7/1979 | United Kingdom . |
| 2061583 | 5/1981 | United Kingdom . |
| 2090033 | 6/1982 | United Kingdom . |
| 2094045 | 9/1982 | United Kingdom . |
| 2143977 | 2/1985 | United Kingdom . |

*Primary Examiner*—Glen R. Swann, III

*Attorney, Agent, or Firm*—Schwartz, Jeffery, Schwaab, Mack, Blumenthal & Evans

[57] ABSTRACT

An intrusion alarm system with an automatic exit control and a misset indicator which informs that someone has trespassed by opening a door during the resident's absence. This system comprises a sequential circuit which is enabled by mode selection by the resident at his/her going out and which stores the door's opening and closing signal produced as an output signal of a door open/closed detection circuit upon a second door opening, a misset alarm device which generates an alarm if the opening of the door is not detected within a predetermined time after the "Absent" mode is placed, and a timer circuit which is operated by the output signal of the sequential circuit and at the time-up to generate alarms. The sequential circuit can be cleared or disabled when the resident comes home and generation of an alarm is then prevented.

6 Claims, 3 Drawing Figures

INTRUSION ALARM SYSTEM WITH AUTOMATIC EXIT CONTROL AND MISSET INDICATOR

BACKGROUND OF THE INVENTION

This invention relates to an improved intrusion alarm system and especially to an alarm system which gives alarms when it detects a trespasser and informs a security center.

An alarm system which detects a trespasser by detecting door opening and closing, when a resident is not in a house, office, room or the like, and which gives an alarm, has been proposed. In this type of alarm system, an alarm signal is generated when a door is opened by someone while the resident is not in the house. For this purpose, a mode selector provided on the control panel of the alarm system is set to the "Absent" mode. However, if the detection is made immediately after the mode setting, the door opening by the resident who is going out might be erroneously detected as the opening by a trespasser.

Therefore, the door opening detection is not performed during a predetermined time interval (e.g. 1 minute) to allow time between mode setting and the final door closing. However, if the resident does not go out after setting of the "Absent" mode within the above mentioned predetermined time, the door opening and closing needed for going out will be detected and the resident will be misconceived as a trespasser. In this type of alarm system, when the trespasser is detected, an alarm signal representing abnormal state is transmitted to a security center, and there will be serious confusion.

SUMMARY OF THE INVENTION

It is an object of the invention to provide an alarm system which can be set easily and reliably.

A further object of the invention is to provide an alarm system which can decrease erroneous alarms because of the opening and closing of the door by the resident after setting of the alarm system.

Another object of the invention is to provide an alarm system which can prevent misconception of the resident as a trespasser even if the resident changes his/her mind after selecting the "Absent" mode.

The invention comprises a mode selection circuit which selects a "Present" mode which represents the presence of a resident in a house, building, room or the like and an "Absent" mode which represents the absence of the resident from the house or the like, the mode selection circuit being set by the resident, a door open/closed detection circuit which detects a door is being in an open state or a closed state, a sequential circuit which operates while said mode selection circuit is set in the "Absent" mode and stores the fact that the door has once been opened and then closed according to the door open/closed detection circuit, detects that the door was opened again, and keeps producing an output signal upon the detection of the second door opening, a misset alarm device which generates an alarm if the opening of the door is not detected by the door open/closed detection circuit within the predetermined time after the mode selection circuit is selected in "Absent" mode, a timer circuit which starts counting upon said second door opening detected by the sequential circuit and produces an output signal upon expiration of a predetermined time as counted from the second door opening and an automatic information device which informs a security center of the detection of a trespasser when the output signal of the sequential circuit and the output signal of the timer circuit are both present.

BRIEF DESCRIPTION OF THE DRAWINGS

The objects and features of the invention may be understood with reference to the following detailed description of embodiments of the invention, taken together with the accompanying drawings in which.

DETAILED DESCRIPTION OF THE EMBODIMENTS

Figure 1:
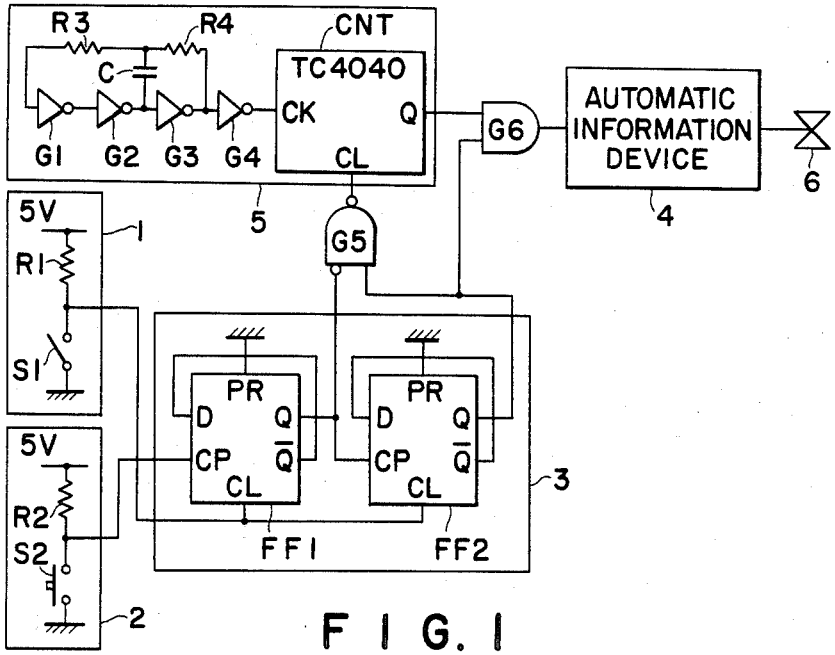
FIG. 1 illustrates a schematic circuit diagram of the main part of the security alarm apparatus of the invention.

FIG. 1 shows a circuit diagram of an intrusion alarm system employing a mode setting circuit 1, a door open/closed detection circuit 2, a sequential circuit 3, an automatic information device 4 and a timer circuits.

The mode selection circuit 1 comprises a pull-up resister R1 and a lock-type normally open switch S1 serially connected between a 5V d.c. power source and ground. The output is derived from the common connection point of the resister R1 and the switch S1, and it is input to the clear (CL) terminals of two D-type flip-flops FF1 and FF2 of the sequential circuit 3.

The door open/closed detection circuit 2 comprises a pull up resister R2 and a switch S2 serially connected between the 5V d.c. power source and ground. The switch S2 is open/closed when the door is open/closed respectively. The output of this circuit is derived from the common connection point of the resister R2 and switch S2 and is input to the clock pulse (CP) terminal of the flip-flop FF1.

The $\overline{Q}$ output of each of the flip-flops FF1 and FF2 which form the sequential circuit 3 is fed back to the D terminal, and Q output of the FF1, the master flip-flop, is input to the CP terminal of FF2, the slave flip-flop. The preset terminals (PR) of each flip-flop are grounded.

The timer circuit 5 comprises a counter CNT and an oscillation circuit comprising four inverters G1 to G4 and a CR circuit composed of resisters R3, R4 and a capacitor C. The output of the oscillation circuit having a known frequency is input to the clock terminal of the counter CNT to divide the frequency and to obtain a predetermined time interval. The timer circuit starts counting in response to the second door opening detected by the sequential circuit and produces an output signal upon expiration of a predetermined time as counted from the second time the door opens. In this embodiment, the counter CNT is a 12 step asynchronous binary counter TC4040 manufactured by Toshiba Corp. The output of NAND gate G5, to which the negative of the Q output of FF1 and the Q output of FF2 are input, is input to the clear (CL) terminal of the counter CNT. The Q output of counter CNT and the Q output of FF2 are input to an AND gate G6, whose output terminal is connected to the automatic information device 4. This device has an output terminal connected to a communication line 6.

When the "Present" mode is selected by opening the switch S1, the power source voltage is fed through the pull-up resister R1 and the output of the mode selection circuit 1 is in a high (H) level. When the "Present" mode is set by the use of the mode selection circuit, FF1, FF2 and the counter CNT are all cleared. Therefore, the alarm will not be generated either when the door is opened or closed. When the switch S1 is closed by selecting the "Absent" mode, the output of the mode selection circuit is pulled down to ground level, i.e. a low (L) state. Before this selection, the two flip-flops FF1 and FF2 are cleared by inputting H state signals to CL terminals and their Q output signals are therefore both at L state.

When the door is closed, the switch S2 is closed and hence the output of the door open/closed detection circuit 2 is at L state. When the door is opened the switch S2 is opened and hence the output of the door open/closed detection circuit 2 goes up to H state. This output signal of the door open/closed detection circuit is input to the CP terminal of FF1 and sets the flip-flop FF1, (since the switch S1 is set at the "Absent" mode), whose Q output therefore goes to an H state. Consequently, the Q output of FF2 goes to H state. When the door is subsequently closed, the output signals of flip-flops FF1 and FF2 will not change, despite the fact that the output of the door open/closed detection circuit changes from H state to L state.

When the door is opened again, the output of the door open/closed detection circuit 2 will be at an H state and the output Q of FF1 will change from H to L . However, the output of FF2 will remain in the H state. Consequently, the output Q of NAND gate G5 goes down, and the counter CNT starts counting. If the setting of the "Present" mode does not occur within the predetermined time interval, the output of the counter will change to the H state, the output of AND gate G6 will go to the H state, and the automatic information device will report the detection of a trespasser to the security center through the communication line.

For a better understanding, description is made on the operation of the apparatus in various typical situations.

(i) When the resident is at home:

In this case, the "Present" mode is set by the use of the mode selection circuit, and FF1, FF2 and CNT are all cleared. Therefore, the alarm will not be generated either when the door is opened or closed.

(ii) When the resident goes out:

The "Absent" mode is set by the resident, and the counter CNT is now not supplied with the clear input. When the door is opened, the outputs of FF1 and FF2 will go to an H state, and therefore the state of the system becomes "ready" for detecting a trespasser. This enables easy and positive setting.

(iii) When a trespasser invades by opening the door:

The counting of the counter starts by opening the door, and if the reset is not performed within the predetermined time interval, for example, one minute, the alarm output is generated after the predetermined time.

(iv) When the resident comes back:

The counter CNT starts counting upon opening of the door. However, the "Absent" mode will be turned to the "Present" mode by the resident within the predetermined time and FF1, FF2 and CNT are all cleared. No alarm will therefore be generated.

Figure 2:
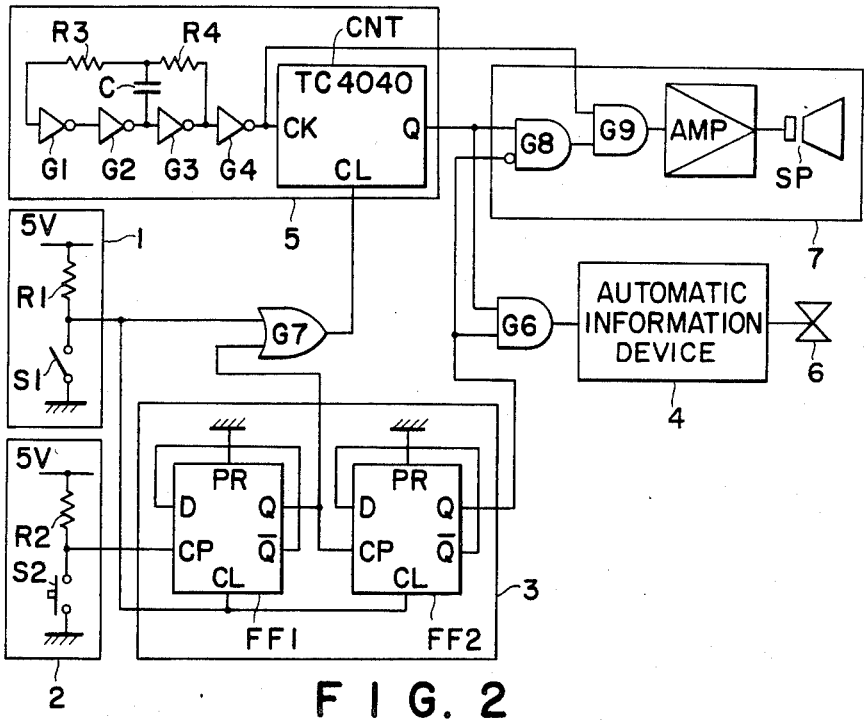
FIG. 2 illustrates a schematic circuit diagram of another embodiment of the invention.

FIG. 2 shows an embodiment of this invention, which also comprises a mode selection circuit 1, a door open/-closed detection circuit 2, sequential circuit 3, automatic information device 4, timer circuit 5 and AND gate G6, being the same as those described in FIG. 1, and their description will thus be omitted. In this embodiment, the output signal of OR gate G7 to which the output of mode selection circuit 1 and the output of flip-flop FF1 are input, is input to the clear (CL) terminal.

The alarm system of this embodiment also has an alarm generation circuit which comprises an AND gate G8 to which the output of counter CNT and the output of flip-flop FF2, through an inverter, are input, an AND gate G9 to which the output of the gate G8 and the output of oscillation circuit are input, an amplifier AMP which amplifies the output of G9 and a loud speaker connected to the amplifier, which is attached to the timer circuit 5. In this embodiment, when the switch S1 of the mode selection circuit 1 is open, two input signals of OR gate G7 are H and L, so that the H state signal is input to the CL terminal of the counter CNT and hence the counting is not performed by the counter CNT. However, if the switch S1 is closed by selecting the "Absent" mode, the output of the mode selection circuit 1 will be an L state, the output of OR gate will be an L state and the counter CNT starts counting. Then if the resident goes out by opening the door within the predetermined time for example one minute, the output of FF1 will be an H state, the output of the OR gate will be an H state, and the counting will be stopped.

However, if the resident will not open the door within the predetermined time, the output of the AND gate G8 will be at an H state because of an L state signal of the output of FF2 and an H state signal output from counter CNT upon time-up, and this output signal of the AND gate and the output of the oscillation circuit are ANDed by the AND gate G9, so that an oscillation (sound) signal is produced at the output of the AND gate G9. This sound signal is amplified through the amplifier AMP and the sound is generated by the loudspeaker to notify the resident of missetting.

This function is effective in the case that a resident who was going out turned the mode selection circuit to "Absent" mode, then changed his or her mind and forgot to reset the mode selection circuit. By this function generation of the unnecessary alarm which might occur when the door is subsequently opened is prevented.

The operation after the selection is similar to the case described referring to FIG. 1, that is, if the "Present" mode is not selected within the predetermined time after door opening, the alarm is generated, and if the "Present" mode is selected within the predetermined time as in the case that the resident comes home, FF1, FF2 and CNT are all cleared and the alarm is not generated.

In the above embodiments, the D-type master-slave flip-flops are used as the sequential circuit, however one can use any other elements which store conditions, such as other types of flip-flop, etc. In addition to the sound generating system in which the sound signal is obtained from the last stage of the oscillation circuit, a suitable frequency easier to hear can be used by obtaining the sound signal from any stage. Moreover, there may be a separate oscillation circuit for generating the sound. The alarm may be in the form of a light radiated from a lamp or the like. Light and sound can be used simultaneously. And in the above embobiment, the logic circuits are active high, but the logic circuits having active low characteristics can be used.

If the building, house or room has plural doors, it is preferable to prepare the elements described in FIG. 1 (excluding automatic information device 4 and communication line 6), and to provide logic addition (OR), for detecting a trespasser even if he trespasses in the house from any door.

Figure 3:
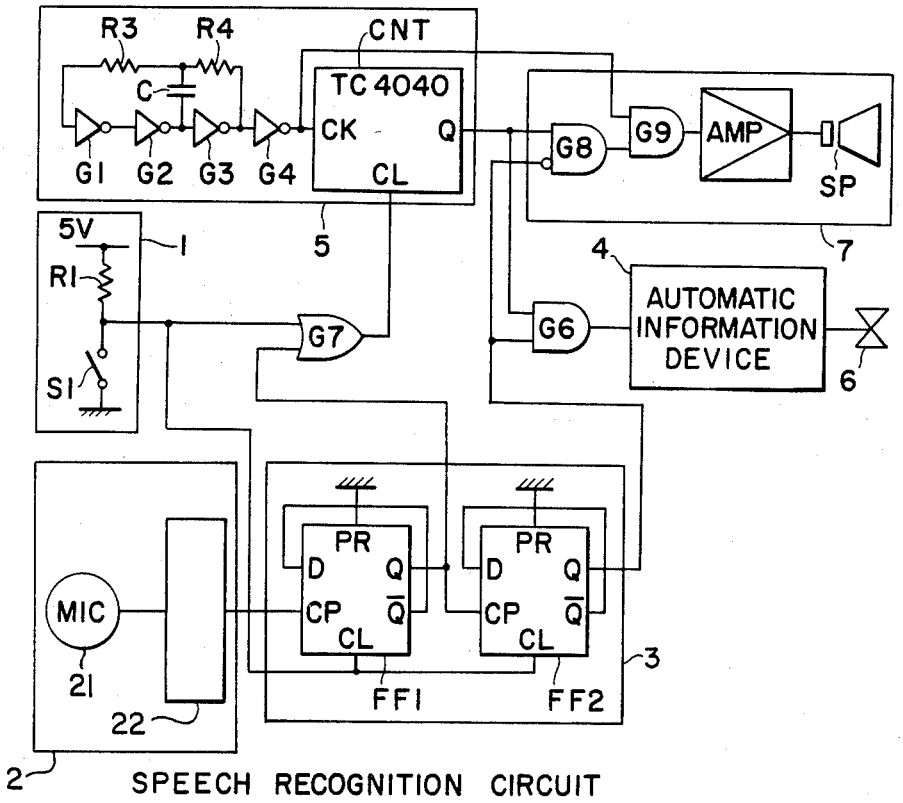
FIG. 3 illustrates a schematic circuit diagram of a further embodiment of the invention.

In the above embodiment, a switch is used to select "Absent" or "Present" mode, however any changeover device selected by the resident himself may be used, for example, it may be operated by voice keyword. FIG. 3 illustrates such an arrangement, in which the system comprises a mode selection circuit 2 having a speech recognition circuit 22 which recognizes the voice sound inputted through a microphone 21 and outputs two different level signals based on the detection result of some special keywords.

The preferred embodiments described herein are therefore illustrative and not restrictive, the scope of the invention being indicated by the appended claims and all variations which come within the meaning of the claims are intended to be embraced therein.

What is claimed is:

1. An intrusion alarm system comprising:

a mode selection circuit which selects a "Present" mode which represents the presence of a resident in a house, building, room or the like and an "Absent" mode which represents the absence of the resident from the house, building, room or the like, said mode selection circuit being set by the resident;

a door open/closed detection circuit which detects a door's being in an open state or a closed state;

a sequential circuit which operates while said mode selection circuit is set in the "Absent" mode and stores signals representative of the door being opened and then closed according to said door open/closed detection circuit, said sequential circuit detecting that the door was opened for a second time after the mode selection circuit is set in the "absent" mode, and producing an output signal upon the detection of the second door opening;

a misset alarm device which generates an alarm if an opening of the door is not detected by said door open/closed detection circuit within a predetermined time after said mode selection circuit is placed in the "Absent" mode;

a timer circuit which starts counting upon said second door opening detected by said sequential circuit and produces an output signal upon expiration of a predetermined time as counted from the second door opening; and an automatic information device which informs a security center of the detection of a trespasser when the output signal of the sequential circuit and the output signal of the timer circuit are both present.

2. The system according to claim 1, in which the sequential circuit comprises a first flip-flop circuit which is enabled when said mode selection circuit is in the "Absent" mode, and which changes its output state when the state of the door is changed from closed to open, and a second flip-flop circuit which changes its output state in response to the change of said first flip-flop circuit.

3. The system according to claim 1, in which the mode selection circuit comprises a manual switch circuit.

4. The system according to claim 1, in which the door open/closed detection circuit comprises a switch operated synchronously with the opening and closing of the door.

5. The system according to claim 1, in which the first and second flip-flop circuits are D-type flip-flop circuits whose negative output terminals are connected to D input terminals, respectively.

6. The system according to claim 1, in which the misset alarm device outputs a sound produced by an oscillator which forms a part of the timer circuit.

* * * * *